US006865369B2

(12) United States Patent
Semmeling et al.

(10) Patent No.: US 6,865,369 B2
(45) Date of Patent: Mar. 8, 2005

(54) RECEPTACLE AND PLUG CONNECTORS

(75) Inventors: Ralph Semmeling, Vlijem (NL); Michael Klein, Le Mans (FR)

(73) Assignee: FCI, Paris (FR)

( * ) Notice: Subject to any disclaimer, the term of this patent is extended or adjusted under 35 U.S.C. 154(b) by 0 days.

(21) Appl. No.: 10/663,127

(22) Filed: Sep. 16, 2003

(65) Prior Publication Data

US 2004/0067689 A1 Apr. 8, 2004

Related U.S. Application Data

(63) Continuation of application No. 10/129,594, filed as application No. PCT/EP00/10621 on Jul. 8, 2002, now Pat. No. 6,692,312.

(30) Foreign Application Priority Data

Nov. 10, 1999 (FR) ..... 99 14411
Nov. 10, 1999 (FR) ..... 99 14410

(51) Int. Cl.[7] ..... H01R 13/627

(52) U.S. Cl. ..... 434/357; 439/352; 439/358; 439/607

(58) Field of Search ..... 439/350–358, 439/953, 607, 604, 610

(56) References Cited

U.S. PATENT DOCUMENTS 5,934,942 A * 8/1999 Patel et al. ..... 439/610
5,941,726 A * 8/1999 Koegel et al. ..... 439/358
6,071,141 A * 6/2000 Semmeling et al. ..... 439/353
6,099,339 A * 8/2000 Yanagida et al. ..... 439/358
6,132,231 A * 10/2000 Suzuki ..... 439/352
6,146,180 A * 11/2000 Betker et al. ..... 439/352
6,234,828 B1 * 5/2001 Kuo ..... 439/358
6,257,914 B1 * 7/2001 Comerci et al. ..... 439/357
6,290,530 B1 * 9/2001 Chang ..... 439/378
6,319,040 B1 * 11/2001 Chang ..... 439/352
6,364,687 B1 * 4/2002 Chen ..... 439/358
6,413,112 B2 * 7/2002 Semmeling et al. ..... 439/358
6,431,901 B1 * 8/2002 Yeh ..... 439/357
6,431,902 B1 * 8/2002 Yeh ..... 439/358
6,454,577 B1 * 9/2002 Yi ..... 439/108
6,454,589 B1 * 9/2002 Yeh ..... 439/352
6,454,592 B2 * 9/2002 Takagi ..... 439/378
6,457,987 B1 * 10/2002 Yeh ..... 439/352
6,540,542 B1 * 4/2003 Simmel ..... 439/352
6,607,397 B1 * 8/2003 Zhang et al. ..... 439/357
6,648,668 B1 * 11/2003 Ko ..... 439/353
6,659,790 B1 * 12/2003 Wu ..... 439/352
6,659,791 B1 * 12/2003 Ko et al. ..... 439/353
6,692,312 B1 * 2/2004 Semmeling et al. ..... 439/733.1
2001/0055903 A1 * 12/2001 Takagi et al. ..... 439/353

FOREIGN PATENT DOCUMENTS

TW 86208161 7/1999

* cited by examiner

*Primary Examiner*—Ross Gushi
(74) *Attorney, Agent, or Firm*—Perman & Green, LLP

(57) ABSTRACT

A receptacle connector (1) for a mobile telephone or the like comprises a housing (3) of insulating material, a shielding (4), and a plurality of contact terminals (5). Channels (13) extend parallel to the lateral sides (11) between the front and backsides (9, 10) and the contact terminals are made as strip like elements mounted in these channels. At least some of the contact terminals each are provided with two retention parts (14,15) having a width greater than the width of the channels providing a retention force mainly parallel to the upper and lower sides. The contact terminals (5) each are provided with a butt-mount contact end (16) and a tail end (17), wherein the retention part at the tail end has a width greater than the width at the butt-mount contact end. A plug connector (34) for interconnecting a mobile device to a stationary device, comprises a housing (36) of insulating material, a shielding (44), a plurality of contact terminals (39) mounted in the housing, at least one latch element (55) to latch the plug connector in a receptacle connector (1) of the mobile device, and a button (60) to operate the latch element. The housing of the plug connector is provided with at least one locating peg (51) to be received in a chamber (51') of the receptacle connector.

17 Claims, 7 Drawing Sheets

RECEPTACLE AND PLUG CONNECTORS

This is a continuation from application Ser. No.: 10/129,594 filed Jul. 8, 2002 now U.S. Pat. No. 6,692,312 which claims the benefit of the earlier filed International Application No. PCT/EP00/10621, International Filing Date, Oct. 25, 2000, which designated the United States of America, and which international application was published on May 17, 2001 as International Publication No. WO 01/35498.

BACKGROUND OF THE INVENTION

1. Field of the Invention

The invention relates to a receptacle connector for a mobile telephone or the like, comprising a housing of insulating material, a shielding, and a plurality of contact terminals, the housing having a mainly rectangular block section with flat upper and lower sides and front, back and lateral sides, wherein channels extend parallel to the lateral sides between said front and back sides, the contact terminals being made as strip like elements mounted in said channels, and to a plug connector for interconnecting a mobile device to a stationary device, comprising a housing of insulating material, a shielding, a plurality of contact terminals mounted in the housing, at least one latch element to latch the plug connector in a receptacle connector of the mobile device, and a button to operate the latch element, wherein the housing is provided with at least one locating peg to be received in a chamber of the receptacle connector.

2. Prior Art

Such receptacle and plug connectors are respectively known from FR-A-2762147 and FR-A-2774516. With ongoing miniaturisation of mobile devices, in particular mobile telephones, there is a need for miniaturised receptacle and plug connectors. Decreasing the sizes of the receptacle and plug connectors however is contrary to strength requirements for connectors of this type used in mobile devices, wherein the receptacle and plug connectors are frequently connected and disconnected.

SUMMARY OF THE INVENTION

The invention aims to provide receptacle and plug connectors of the above mentioned type having miniature dimensions in combination with a high strength.

To this end the receptacle connector of the invention is characterised in that at least some of the contact terminals each are provided with two retention parts having a width greater than the width of the channels providing a retention force mainly parallel to said upper and lower sides, wherein the width of the channels at their upper wall near the upper side of the housing is smaller than the width at their lower wall near the lower side of the housing to force the contact terminals against the lower wall, and wherein the contact terminals each are provided with a butt-mount contact end and a tail end, wherein the retention part at the tail end has a width greater than the width at the butt-mount contact end.

In this manner the contact terminals can be mounted with a high retention force and at an accurately determined position in the housing of the receptacle connector, wherein the load on the walls between the channels is parallel to the upper and lower sides of the housing to prevent breakage of these intermediate walls.

The plug connector of the invention is characterised in that the housing comprises inner and outer sections, the inner section being made as a contact block accommodating the contact terminals, the outer section being made as interconnected bottom and top covers, wherein the outer section includes the locating peg(s) and the button.

In this manner the material of the inner section can be optimised for miniature dimensions, whereas the material of the outer section can be optimised for strength of the locating peg(s).

BRIEF DESCRIPTION OF THE DRAWINGS

The invention will be further explained by reference to the drawings in which embodiments of the receptacle and plug connectors of the invention are shown.

DETAILED DESCRIPTION OF THE INVENTION

Figure 1:
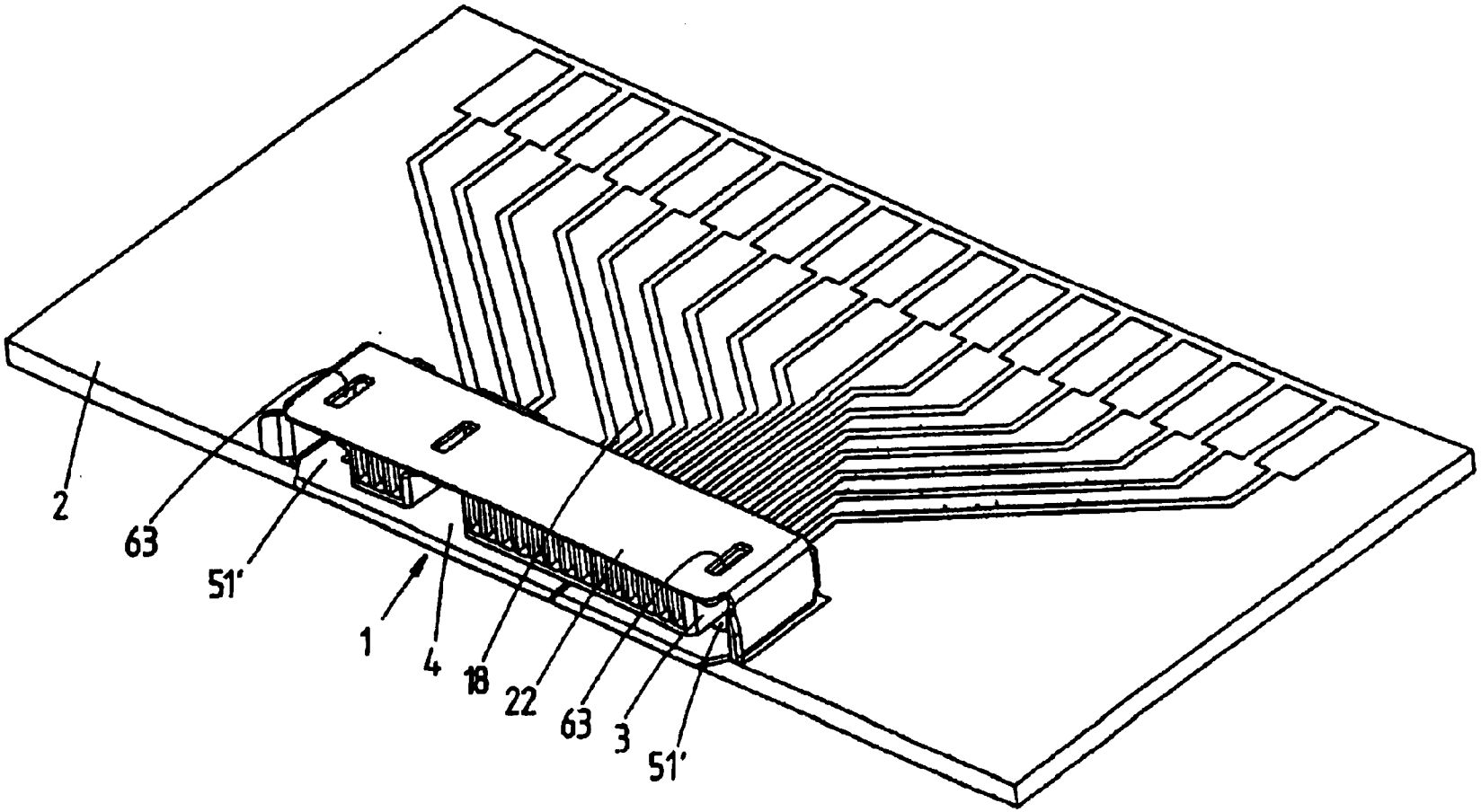
FIG. 1 shows a perspective view of an embodiment of the receptacle connector as mounted on a printed circuit board.

FIG. 1 shows a perspective view of a receptacle connector 1 mounted on a printed circuit board 2 of a mobile device, in particular a mobile telephone. The receptacle connector 1 comprises a housing 3 of insulating material, a metal shielding 4, and a plurality of contact terminals 5, shown in FIG. 3 together with the housing 3.

Figure 3:
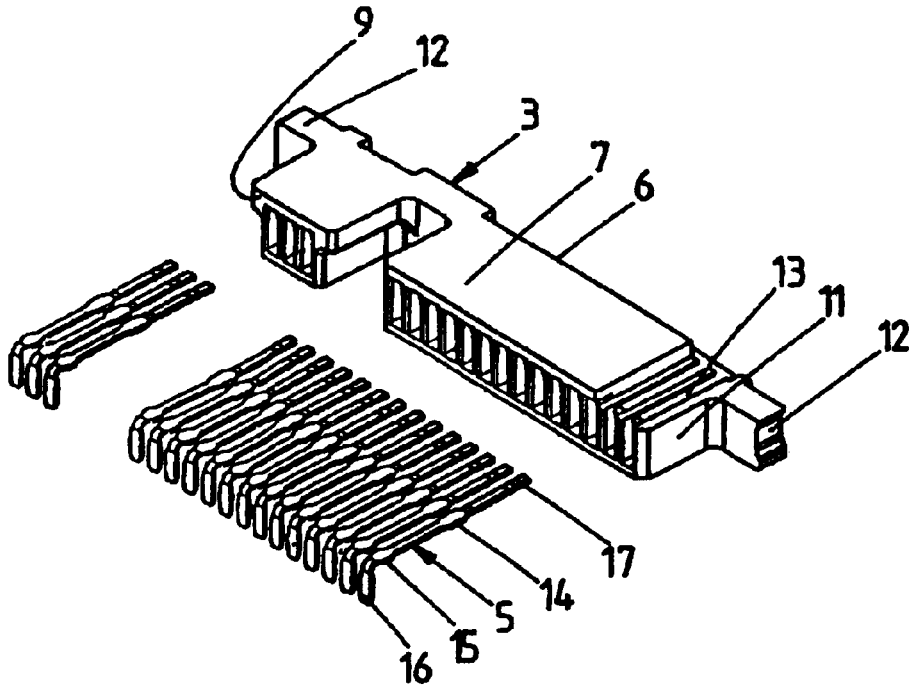
FIG. 3 shows a perspective view of the connector housing and contact terminals of the connector of FIG. 1, a part of the housing being broken away to show the channels in the housing.

The housing 3, a part of which is broken away in FIG. 3, has a mainly rectangular block section 6 with flat lower and upper sides 7,8, and front, back and lateral sides 9,10,11 respectively. At both lateral sides 11 the housing block 6 is provided with a lug 12 near the backside 10. The housing 3 is provided with channels 13 extending parallel to the lateral sides 11 between the front and backsides 9,10. Each channel 13 accommodates a contact terminal 5.

Figure 2:
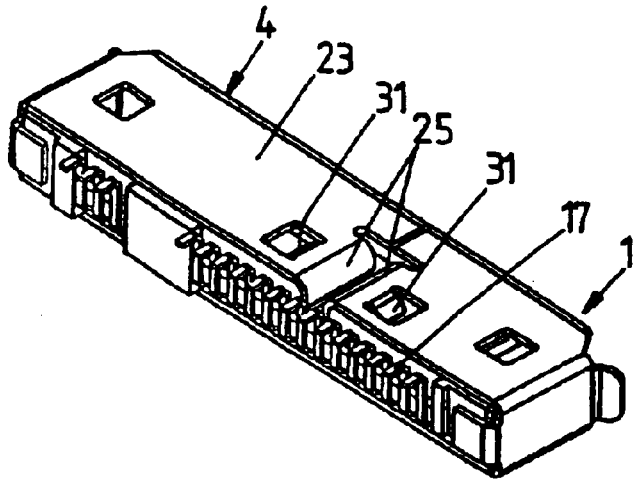
FIG. 2 is a perspective view of the receptacle connector of FIG. 1 from the lower side.
Figure 5:
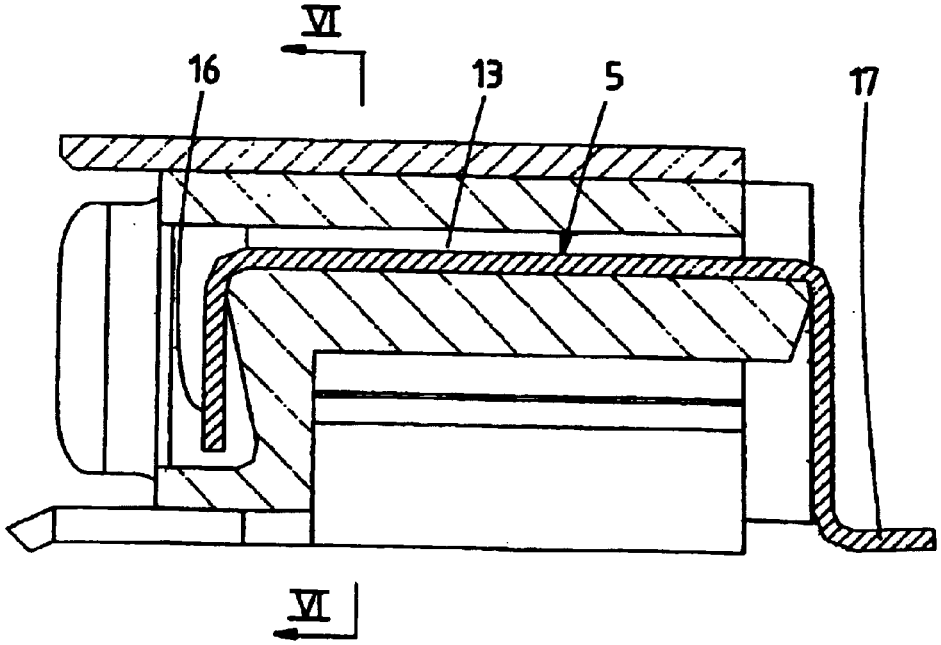
FIG. 5 is a cross section of th connector of FIG. 1.

The contact terminals 5 each are made as a strip-like element having two retention parts 14,15 having a width greater than the width of the channels 13. As shown in FIGS. 2,3 and 5, each contact terminal 5 is provided with a butt-mount contact end 16 and a solder tail end 17, wherein the tail ends 17 are connected to the circuit tracks 18 of the printed circuit board 2 using a surface mount technology. Although the contact terminals 5 are shown in FIG. 3 separate from the housing 3 with their contact ends 16 being bent perpendicular to the remaining part of the contact terminal, the contact terminals 5 are inserted before bending into the channels 13 from the back sid 10 of the block section 6. In this manner, the surface mount tail ends 17 can not be affected during inserting the contact terminal into the housing and bending them after insertion allows to get a significantly better coplanarity of the tail ends.

Figure 6:
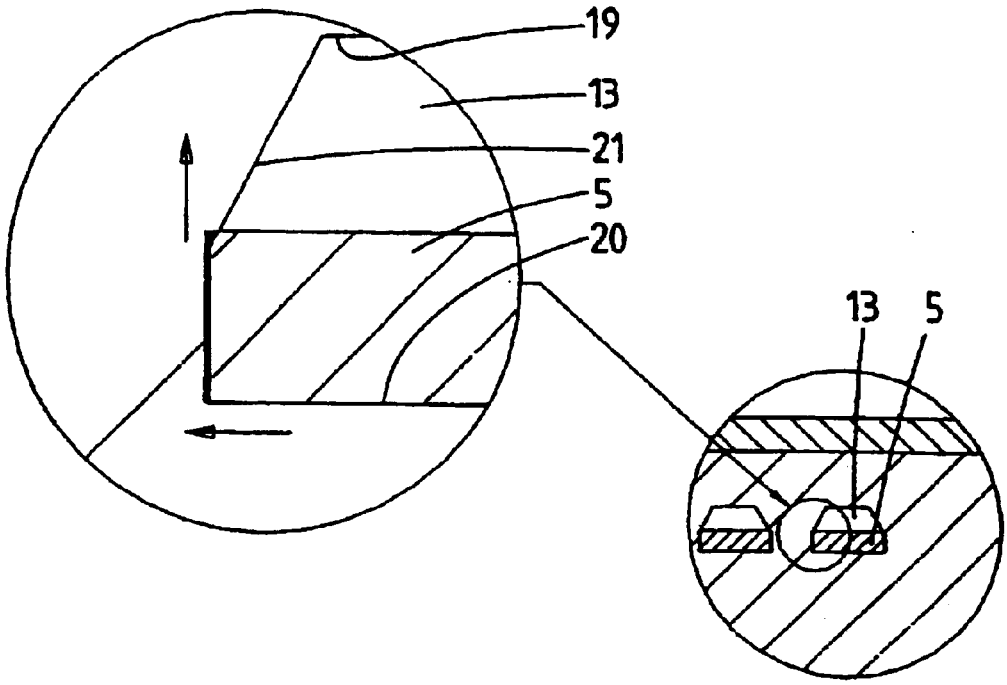
FIG. 6 partly shows a cross section of the connector of FIG. 1 according to the line VI—VI in FIG. 5 with a detail at a larger scale.

As shown in FIG. 5, the height of the channels 13 is greater than the thickness of the strip-like contact terminals 5, whereas as shown in the cross section of FIG. 6, the width of the channels 13 at their upper wall 19 near the upper side 7 of the housing 3 is smaller than the width at their lower wall 20 near the lower side 8 of the housing 3. The retention part 14 at the tail end 17 of each contact terminal has a width greater than the width of the retention part 15 at the butt-mount contact end 16 in order that this retention part 15 also serves as a guiding part. In this manner upon insertion of a contact terminal 5 into a channel 13 the retention forces will mainly be extending parallel to the upper and lower sides 7,8 of the housing 3, while relatively small retention forces are directed perpendicular to the upper and lower sides 7,8. In this manner relatively high retention forces to mount the contacts stationary in the housing 3 can be obtained without causing breakage of the thin intermediate walls between the channels 13 of the housing due to high outwardly directed loads on the upper and lower sides 7,8.

The small interference between the upper side of the contact terminals 5 and the oblique side walls 21 of the channels 13 guarantee that the contact terminals 5 are forced downwardly on the lower walls 20 of the channels 13. The lower walls 20 are lying in one common reference plane, so that the interference between the contact terminals 5 and the oblique side walls 21 of the channels attributes in a favourable manner to the coplanarity of the tail ends 17 of the contact terminals.

The shielding 4 of the receptacle connector 1 is made as a casing having upper and lower plates 22,23 interconnected by side plates 24, wherein the upper and lower plates 22,23 contact the upper and lower sides 7,8 of the housing 3. The lower plate 23 is provided with two positioning lips 2S engaging a positioning slot 26 provided in the lower side 8 of the block section 6. As shown in the drawings, the positioning lips 25 and the co-operating side walls of the positioning slot 26 are formed in such a manner that the lower plate 23 can not be forced away from the lower side 8. Other shapes providing such a fixation of the lips 25 are possible. The positioning slot 26 of the housing 3 is open at the back side 10 and is provided with a stop 27 at the front side 9 which abuts against stop edges 28 of the positioning lips 25 when the housing 3 is received within the shielding 4 during manufacturing. This allows to accurately and efficiently tighten and fix the shielding 4, which is cut in this area.

Figure 4:
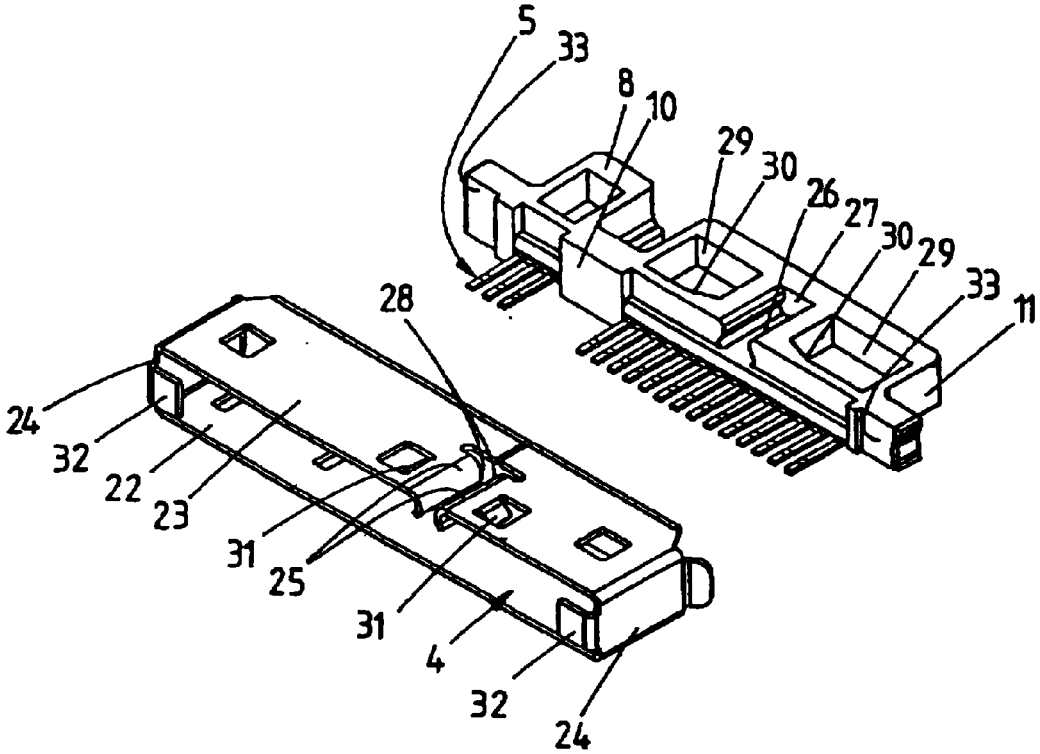
FIG. 4 shows a perspective view from the bottom side of the shielding and the housing of the connector of FIG. 1.

As shown in FIG. 4, the lower side 8 of the block section 6 is provided with two recesses 29, each recess having an oblique wall 30. The lower plate 23 of the shielding 4 is provided with two bending lips 31 which after inserting the housing 3 into the shielding 4 are pressed downwardly into the recesses 29 and by co-operation of these bending lips 31 with the oblique walls 30, the stop edges 28 are forced against the stop 27 of the positioning slot 26. Further, stop plates connected to the side plates 24 co-operate with stop faces 33 of the lugs 12. In this manner an accurate positioning and fixation of the housing 3 within the shielding 4 is guaranteed.

In view of the design of the receptacle connector 1, the dimensions of the connector can be minimised. In practice, the contact terminals 5 can be mounted at a pitch of 0.8 mm. Retention forces can be high as the retention forces are mainly parallel to the upper and lower sides 7,8 of the housing. Further, as the shielding 4 fully encloses the housing 3, preferably with a snug fit between upper and lower sides 7,8 and upper and lower plates 22,23, the shielding provides further strength to the connector.

It is noted that the contact terminals 5 are preferably mounted into the channels 13 in such a manner that the rounded side edges caused by stamping are located at the side of the lower walls 20 of the channels 13. In this manner an accurate positioning of the contact terminals is achieved, while damage to the lower walls 20 during insertion of the contact terminals is prevented.

Figure 7:
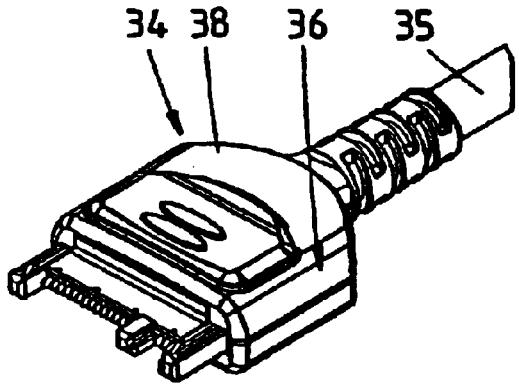
FIG. 7 shows a perspective view of an embodiment of the plug connector of the invention.
Figure 8:
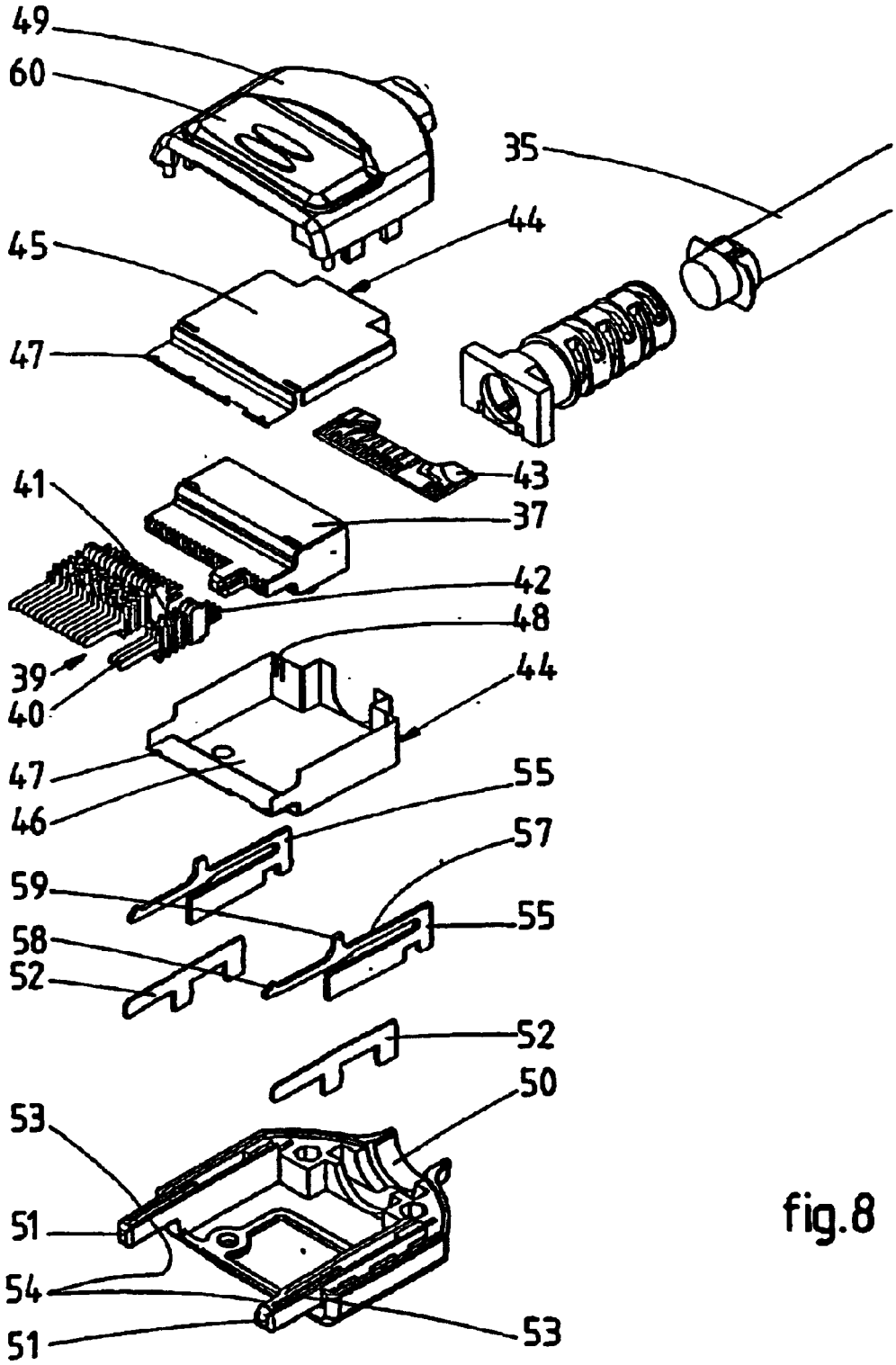
FIGS. 8–10 show exploded views of the plug connector of FIG. 7.
Figure 9:
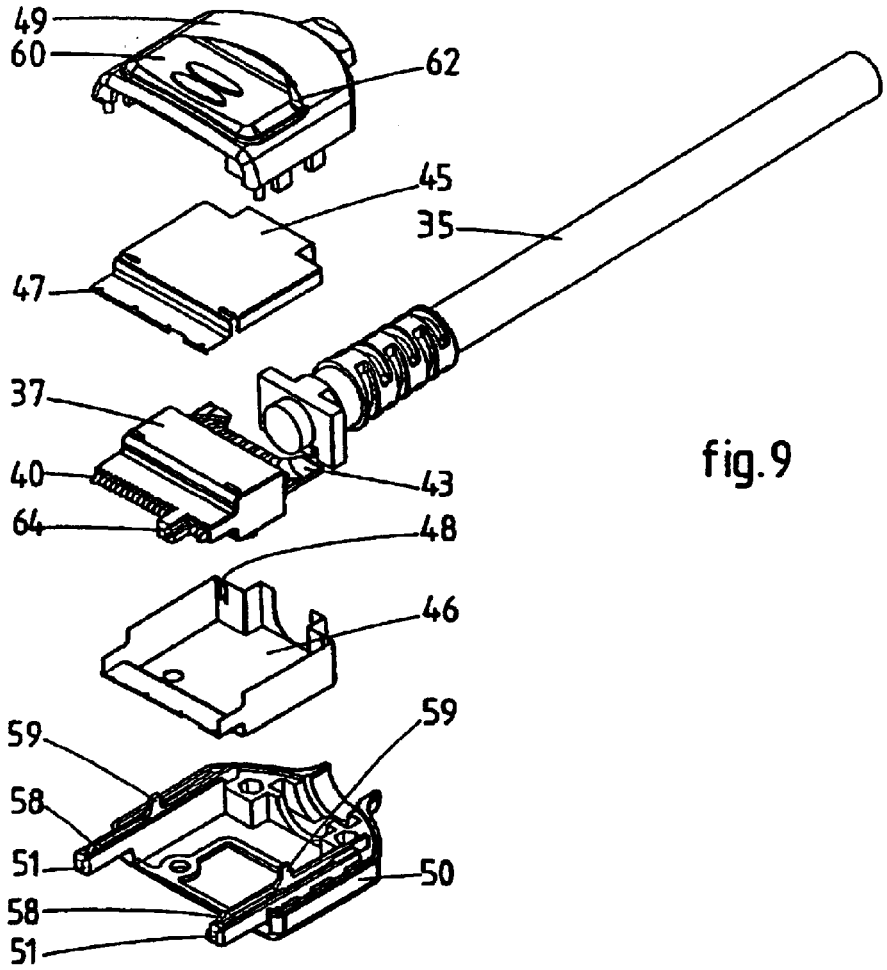
Figure 10:
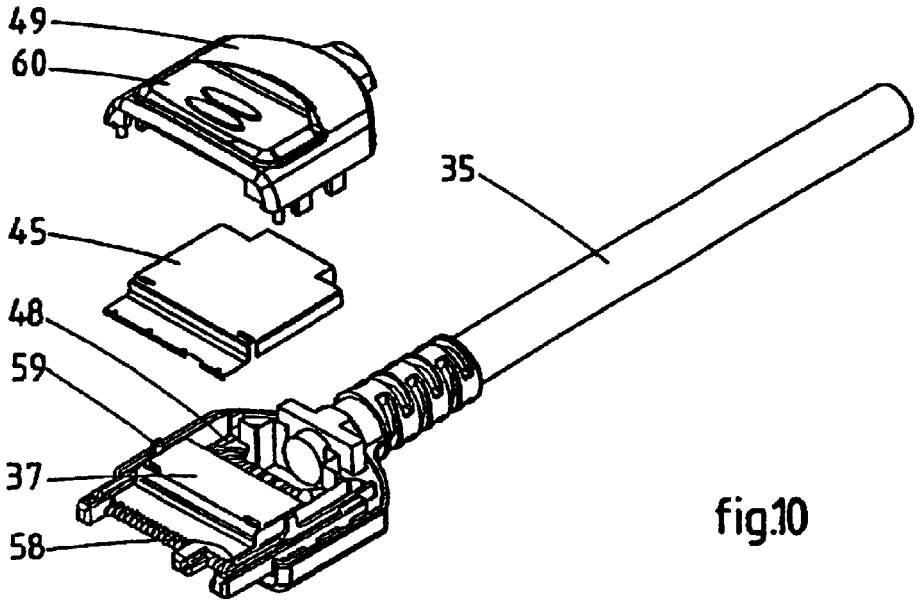

FIG. 7 is a perspective view of a plug connector 34 adapted to be inserted into the receptacle connector 1 of FIG. 1. In the embodiment shown the plug connector 34 is connected to a cable 35. FIGS. 8–10 show exploded views of the plug connector 34 in various stages during assembly.

The plug connector 34 comprises a housing 36 of insulating material including an inner section 37 and an outer section 38. The inner section 37 is made as a contact block accommodating contact terminals 39 having a contact end 40, an intermediate spring section 41 and a connection end 42. The contact ends project out of the plug connector 34 as can be seen in FIG. 7. The connection ends 42 are connected to a printed circuit board 43 located at the backside of the outer section 38. The wires of the cable 35 are also connected to the printed circuit board 43 (for the sake of clarity the wires are not shown in the drawings). The inner section 37 together with the printed circuit board 43 are mounted within a shielding 44 having an upper shielding plate 45 and a lower shielding plate 46. At the front end the shielding plates 45,46 are provided with contact dimples 47 adapted to contact the shielding 4 of the receptacle connector 1. The lower shielding plate 46 is provided with solder lips 48 connected to the printed circuit board 43 as shown in FIG. 10. The complete interconnection of the cable wires to the contact terminals 39 is fully shielded in this manner.

The outer section 38 comprises a top cover 49 and a bottom cover 50. The bottom cover 50 is provided with two locating pegs 51, one at each side. The locating pegs 51 are received in locating openings 51' of the receptacle connector 1 located between the lateral sides 11 of the block section 6 and the side plates 24 of the shielding 4.

The dimensions of the plug connector 34 described can be miniaturised as the material of the inner section 37 of the housing 36 can be optimised for manufacturing in small dimensions, whereas the material of the outer section 38 can be optimised for strength of the locating pegs 51. The locating pegs 51 are further reinforced by mounting a peg blade 52 inside a slot 53 in the peg 51.

At the inner side of the peg blade 52 a further slot 54 is provided in the locating pegs 51 for mounting a latch blade 55. As shown in FIG. 8, each latch blade 55 comprises a lower part 56 carrying at one side an upper spring part 57 and at its free end the spring part 57 carries a latch 58. The spring part 57 can be operated by means of an extension 59 projecting upwardly from the spring part 57 for coupling to a button 60 which is part of the top cover 49 of the outer section 38, It is noted that in view of the design of the bottom cover 50 with slots 53,54 open at their upper sides, the peg blades 52 and the latch blades 55 can be assembled with the bottom cover 50 by top loading, which results in an advantageous manufacturing step.

Figure 11:
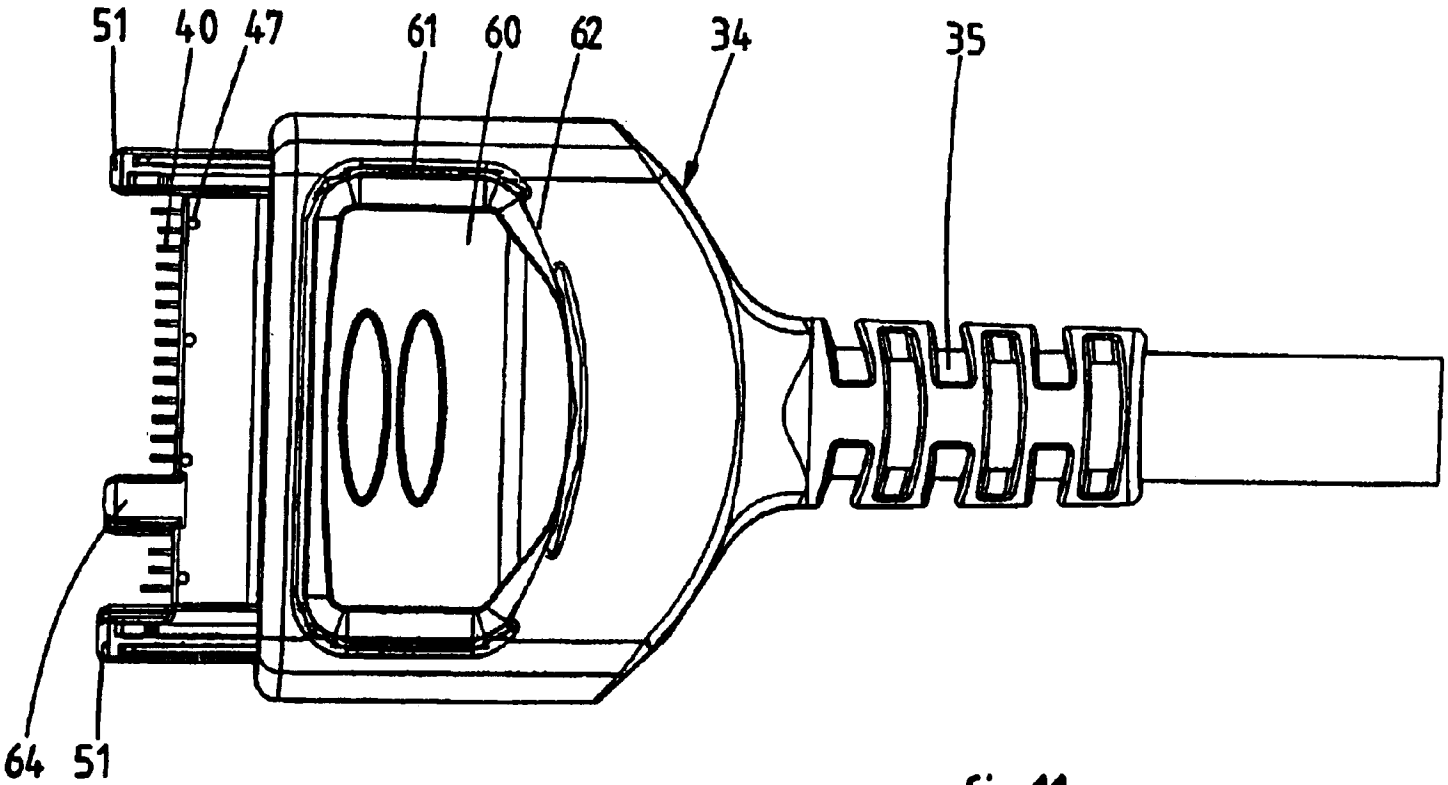
FIG. 11 shows a top view of the plug connector of FIG. 7.

The button 60 is an integral part of the top cover 49 and is separated from the top cover along a major part of its circumference by a slot 61 as can be seen in FIG. 11. The button 60 is interconnected to the top cover 49 by two hinges 62, wherein the button 60 is relatively rigid between these two hinges 62. In this manner it is guaranteed that independent of the location of the pressing force on the button 60, both latches 58 are operated.

Upon insertion of the plug connector 34 into the receptacle connector 1, the latches 58 are received in latch pockets 63 provided in the upper plate 22 of the shielding 4. For removal of the plug connector 34, the button 60 is pressed downwardly releasing the latches 58 from the latch pockets 63.

It is noted that the inner section 37 is provided with a peg 64 projecting with respect to the projecting contact ends 40 of the contact terminals 39 to protect these projecting contact ends 40 against deformation.

The invention is not restricted to the above-described embodiments of the connectors 1 and 34, which can be varied in a number of ways within the scope of the attached claims.

What is claimed is:

1. A plug connector for a mobile device, the plug connector comprising:

an insulating housing having a first section adapted for mating with a receptacle connector, the first section being adapted for holding contact terminals therein, the insulating housing having a second section, distinct from the first section, for mating with the receptacle connector, wherein the second section has at least one latching peg for latching the plug connector to the receptacle connector, the at least one latching peg being an assembly comprising a peg frame, a movable latch member. mounted to the peg frame, and a reinforcing member mounted to the peg frame and being independent from the movable latch member.

2. The plug connector according to claim 1, wherein the peg frame depends from the insulating housing.

3. The plug connector according to claim 1, wherein the at least one latching peg projects from a mating face of the plug connector.

4. The plug connector according to claim 1, wherein the movable latch member is spring loaded.

5. The plug connector according to claim 1, wherein the reinforcing member is a reinforcing blade.

6. The plug connector according to claim 1, further comprising a latch actuator movably mounted to the insulating housing for actuating the movable latch member.

7. The plug connector according to claim 1, further comprising shielding connected to the insulating housing and disposed between the first section and the second section of the insulating housing.

8. The plug connector according to claim 1, wherein the movable latch member comprises a latch blade with a base part and a spring arm extending from and alongside the base part, the spring arm having a projection thereon defining a latch.

9. The plug connector according to claim 8, wherein the reinforcing member extends alongside the latch blade when mounted in the peg frame.

10. A connector assembly for a mobile device, the assembly comprising:

a receptacle connector; and a plug connector capable of being connected to the receptacle connector, and having an inner insulating housing with contact terminals located therein, and an outer housing outside the inner housing, the outer housing having at least one locating peg for coupling the plug connector to the receptacle connector, a movable latch member, mounted to a portion of the outer housing that forms the at least one locating peg, and a locating peg reinforcing member mounted apart from the movable latch member to the portion of the outer housing that forms the at least one locating peg.

11. The connector assembly according to claim 10, wherein the outer housing has a movable actuator for operating the movable latch member.

12. The connector assembly according to claim 10, wherein the movable latch member is a spring loaded latch member.

13. The connector assembly according to claim 10, wherein the at least one locating peg comprises two locating pegs proximate opposite sides of the outer housing.

14. The connector assembly according to claim 10, wherein the outer housing comprises interconnectable top and bottom sections configured so that when interconnected the top and bottom sections surround the inner insulating housing.

15. The connector assembly according to claim 10, wherein the plug connector comprises shielding located between the inner housing and the outer housing and surrounding the inner housing.

16. The connector assembly according to claim 10, wherein the movable latch member is a first blade mounted in a first slot of the outer housing.

17. The connector assembly according to claim 16, wherein the locating peg reinforcing member is a second blade mounted in a second slot of the outer housing.

* * * * *